US009327286B2

(12) United States Patent
Trebucchi et al.

(10) Patent No.: US 9,327,286 B2
(45) Date of Patent: May 3, 2016

(54) MILL FOR GRINDING RUBBISH

(75) Inventors: Piervittorio Trebucchi, Rivoltella del Garda (IT); Norbert Eich, Mediglia (IT); Lorenzo Zubani, Rivoltella del Garda (IT)

(73) Assignee: CHRYSOPOEIA SRL, Brescia (IT)

( * ) Notice: Subject to any disclaimer, the term of this patent is extended or adjusted under 35 U.S.C. 154(b) by 349 days.

(21) Appl. No.: 13/983,250

(22) PCT Filed: Feb. 9, 2012

(86) PCT No.: PCT/IB2012/050591

§ 371 (c)(1), (2), (4) Date: Aug. 1, 2013

(87) PCT Pub. No.: WO2012/117307

PCT Pub. Date: Sep. 7, 2012

(65) Prior Publication Data

US 2013/0305969 A1 Nov. 21, 2013

(30) Foreign Application Priority Data

Mar. 1, 2011 (IT) ..... MI2011A0320

(51) Int. Cl.

| | |
|---|---|
| ***B02C 13/28*** | (2006.01) |
| ***B02C 13/26*** | (2006.01) |
| ***B02C 13/14*** | (2006.01) |
| ***B02C 13/20*** | (2006.01) |
| ***B02C 21/00*** | (2006.01) |

(52) U.S. Cl.

CPC ..... *B02C 13/26* (2013.01); *B02C 13/14* (2013.01); *B02C 13/20* (2013.01); *B02C 13/28* (2013.01); *B02C 21/00* (2013.01); *B02C 2013/2816* (2013.01); *B02C 2201/06* (2013.01)

(58) Field of Classification Search

CPC ..... B02C 13/20; B02C 13/26; B02C 13/28; B02C 2013/2816

USPC ..... 241/193, 60, 257.1

See application file for complete search history.

(56) References Cited

U.S. PATENT DOCUMENTS

| | | | | |
|---|---|---|---|---|
| 359,630 | A | 3/1887 | Pratt | |
| 1,351,711 | A * | 8/1920 | White | A23N 7/02 241/193 |

(Continued)

FOREIGN PATENT DOCUMENTS

| | | | |
|---|---|---|---|
| CN | 2152602 | Y | 1/1994 |
| CN | 201109766 | Y | 9/2008 |

(Continued)

OTHER PUBLICATIONS

PCT International Search Report and Written Opinion dated Jul. 3, 2012 for Intl. App. No. PCT/IB2012/050591, from which the instant application is based, 8 pgs.

(Continued)

*Primary Examiner* — Faye Francis

(74) *Attorney, Agent, or Firm* — Fredrikson & Byron, P.A.

(57) ABSTRACT

A mill for grinding rubbish. The mill comprises at least one grinding chamber defined by a side wall and a floor. The mill also comprises at least two rotors and rotatable about respective substantially vertical axes and. Each of the rotors comprises a hub and a plurality of chains connected to the hub and designed to sweep over part of the grinding chamber during rotation of the rotor.

14 Claims, 8 Drawing Sheets

(56) References Cited

U.S. PATENT DOCUMENTS

| | | | | | |
|---|---|---|---|---|---|
| 1,439,581 | A * | 12/1922 | Sedberry | B02C 13/28 | 241/138 |
| 1,728,976 | A * | 9/1929 | Nobis | B02C 13/16 | 241/188.1 |
| 3,161,412 | A * | 12/1964 | Ferris | A01C 3/063 | 172/45 |
| 3,342,426 | A * | 9/1967 | Sackett, Sr. | B02C 13/04 | 241/189.1 |
| 3,606,265 | A | 9/1971 | Cobey | | |
| 3,993,256 | A * | 11/1976 | Brewer | B02C 13/16 | 241/186.35 |
| 4,572,258 | A * | 2/1986 | Mischel | B27L 1/122 | 144/208.7 |
| 4,654,938 | A * | 4/1987 | Dalseide | B08B 7/024 | 241/193 |
| 4,947,906 | A * | 8/1990 | Schroeder | B27L 1/122 | 144/208.1 |
| 5,148,844 | A * | 9/1992 | Robison | A01G 23/097 | 144/208.7 |
| 5,184,781 | A * | 2/1993 | Andela | B02C 13/20 | 241/188.1 |
| 5,322,104 | A * | 6/1994 | Morey | B27L 1/122 | 144/208.7 |
| 5,522,913 | A * | 6/1996 | Peguy | B02C 13/20 | 241/193 |
| 5,630,556 | A * | 5/1997 | Chrestenson | B02C 13/02 | 241/101.76 |
| 5,697,563 | A * | 12/1997 | Fujimoto | B02C 13/16 | 241/102 |
| 6,039,277 | A * | 3/2000 | Hamm | B02C 13/16 | 241/1 |
| 7,891,593 | B2 * | 2/2011 | Gronholz | B02C 13/14 | 241/188.1 |
| 2006/0124787 | A1 | 6/2006 | Schweiger | | |

FOREIGN PATENT DOCUMENTS

| | | |
|---|---|---|
| EP | 2062645 A1 | 5/2009 |
| IT | 1317056 B1 | 5/2003 |

OTHER PUBLICATIONS

Italian Search Report and Written Opinion dated Oct. 14, 2011 for related IT App. No. MI20110320, 7 pgs.

* cited by examiner

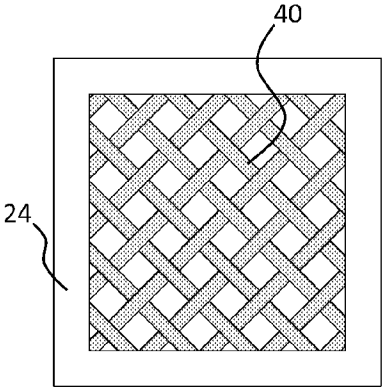
Fig. 10.a
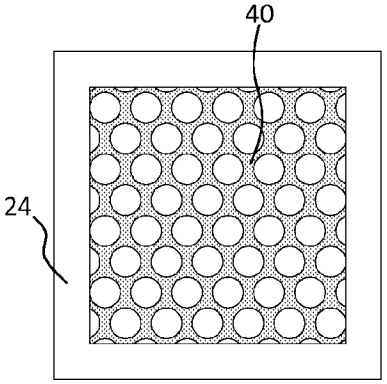
Fig. 10.b
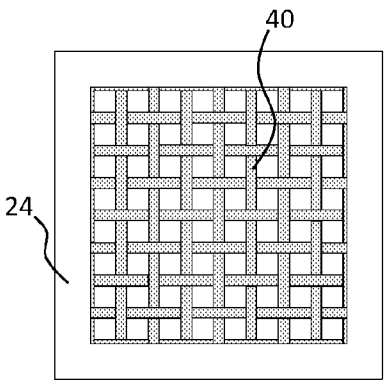
Fig. 10.c
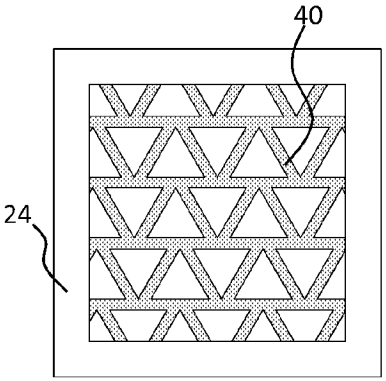
Fig. 10.d
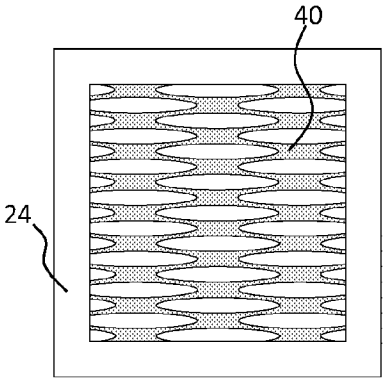
Fig. 10.e
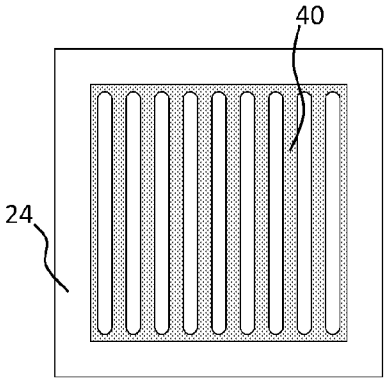
Fig. 10.f

MILL FOR GRINDING RUBBISH

RELATED APPLICATIONS

This application is a 35 U.S.C. 371 national stage filing from International Application No.PCT/IB2012/050591 filed Feb. 9,2012 and claims priority to Italian Appliction No. MI2011A00320 filed Mar. 1,2011, the teachings of which are incorporated herein by reference.

FIELD OF THE INVENTION

The present invention relates to a mill for grinding rubbish, in particular for fine grinding municipal solid waste (MSW), industrial waste, special waste and similarly processable waste, for the purposes of conversion into refuse-derived fuel (RDF) or secondary solid fuel. The invention also relates to a plant for recycling energy from the waste.

The preferred area of application of the invention is that of grinding municipal solid waste, to which extensive reference will be made during the following description, without thereby excluding other possible applications which have similar requirements, in connection with the treatment of waste a number of different grinding apparatus are known which are briefly described below in some of their essential features.

BACKGROUND

A first type of plant is that described in Italian patent IT1317056. This plant has been designed in order to implement a relatively complex waste treatment method. It is therefore characterized by a succession of apparatuses, each of which is designed to perform a specific function within the framework of the overall method. In this plant the municipal solid waste (MSW) is converted into so-called Refuse-Derived Fuel or RDF. This known type of plant, although very appreciated owing to the quality of the finished product, is not without drawbacks.

A first series of drawbacks consists of those associated with the complexity and therefore with the delicate nature of the waste treatment method. In particular a weak point of the plant has been identified in the counter-rotating blade mill, operation of which is easily affected or prevented by material which is difficult to grind. During the treatment of municipal solid waste, despite recent legislation aimed at ensuring the recycling or alternative disposal of special waste, it is not possible to exclude the presence of bodies which have a very strong structure, typically mineral or metallic bodies which are non-magnetic (and therefore cannot be eliminated by the devices usually situated upstream of the grinding stage, such as the so-called metal separators). The presence of such bodies prevents correct operation of the counter-rotating blade mill and therefore of the entire plant described in IT1317056. Whenever such an event occurs it is therefore required to stop the whole plant and maintenance personnel must intervene in order to remove the bodies which cannot be ground.

A second series of drawbacks associated with this type of plant is that of the overall energy consumption which is required for the entire processing operation. This energy consumption may be quantified at a figure of more than 250 kW for each tonne of waste processed. This figure is relatively high, in particular in view of the fact that it is required to add the further energy needed to remove, before loading the machine, all those components which may create problems (typically metal and mineral masses of any size) and finally to reduce the particle size of the material. The RDF discharged from the plant is in fact composed of parts which have a particle size in the region of 25-30 mm. which is too large for direct fuelling of a burner if the RDF is not combined with a larger quantity of another fuel, typically a fossil fuel. As things stand at the moment, therefore, the RDF produced by the plants of the known type, in order to be able to ensure effective combustion must be used in quantities of between 25% and 35%. Alternatively, said RDF could be further reduced in size in order to achieve a particle size of about 5-10 mm, with a further increase in the energy consumption, thus further reducing the overall energy efficiency of the processing method.

In addition to the drawbacks mentioned above, a further drawback has been encountered: the presence in the MSW of bodies which cannot be ground results in the use of a large amount of mechanical energy which, when protracted over time up to the removal of such non-ground bodies, results in a local increase in temperature. Within the mass of the MSW being processed, which on the whole remains at a temperature close to room temperature, some points may therefore reach temperatures which are much higher, even of the order of hundreds of degrees Celsius. These temperatures may easily produce softening of the polymer fractions present in the MSW and, eventually, blockage of the output grilles for the ground waste.

A second type of known plant is that described in the patent document EP2062645A1. This plant has been specifically developed for the treatment of so-called Waste of Electric and Electronic Equipment (WEEE). It comprises a mill consisting of a grinding chamber inside which a rotor operates. The rotor comprises a hub to which some chains are connected. The rotation of the hub causes rotation of the chains which, subject to the centrifugal force, are arranged radially and sweep the grinding chamber. The WEEE, introduced from above, is struck by the chains and is subject to a series of impacts and rebounding movements which cause it to be gradually broken up.

The use of this type of mill has proved to be relatively efficient only in connection with the WEEE for which it has been designed. Generally such waste has a fairly rigid structure which therefore gives rise to elastic collisions and, following more violent impacts, to elastic-brittle fractures which absorb a low amount of deformation energy. Owing to these characteristics of WEEE, in a short amount of time a large number of knocks and impacts are produced, resulting in an efficient breaking down of the material to an acceptable particle size.

The use of this type of mill has, however, not proved to be suitable for other types of waste, typically MSW and similarly processable waste (referred to below overall as MSW in short). Said waste in fact has a structure which, although it cannot be easily defined, overall has a very different behaviour in relation to the impacts, compared to WEEE. The mass of MSW in fact has an elasto-plastic behaviour or even a visco-plastic behaviour when there is a significant wet fraction. Such a behaviour results in collisions which are mostly inelastic and which absorb a large quantity of deformation energy. In other words, the MSW, introduced from above into the mill, is struck by the chains and, without any rebounding action, adheres to them and simply starts to rotate. The overall primary effects of this behaviour of the MSW consist in long dwell times inside the grinding chamber and high energy consumption due to the fragmentation process which is achieved by means of successive tearing produced by friction. Alongside these drawbacks there is at least one other drawback resulting therefrom. The long dwell time of the MSW inside the grinding chamber and the large amount of mechanical energy absorbed by it result in a general increase in the temperature of the mass being processed. This increase in temperature may easily result in softening of the polymer fractions present in the MSW and, in this case also, in the blockage of the output grilles for the ground waste.

Brief Summary of Embodiments of the Inention

The object of the present invention is therefore to overcome at least partly the drawbacks mentioned above with reference to the prior art.

In particular, one task of the present invention is to provide a mill suitable for grinding different types of waste.

Another task of the present invention is to provide a mill which has a high energy efficiency.

Another task of the present invention is to provide a mill with a simple structure.

Another task of the present invention is to provide a mill which allows a reduction in the bacterial content present in the mass treated inside it.

Another task of the present invention is to provide a plant which allows easy and efficient recycling of energy from the waste, in particular from MSW.

The abovementioned object and tasks are achieved by a mill according to Claim 1 and by a plant according to Claim 13.

Brief Descriptions of Drawings

The characteristic features and further advantages of the invention will emerge from the description provided below, of a number of examples of embodiment, provided by way of a non-limiting example, with reference to the accompanying drawings in which.

Figure 1:
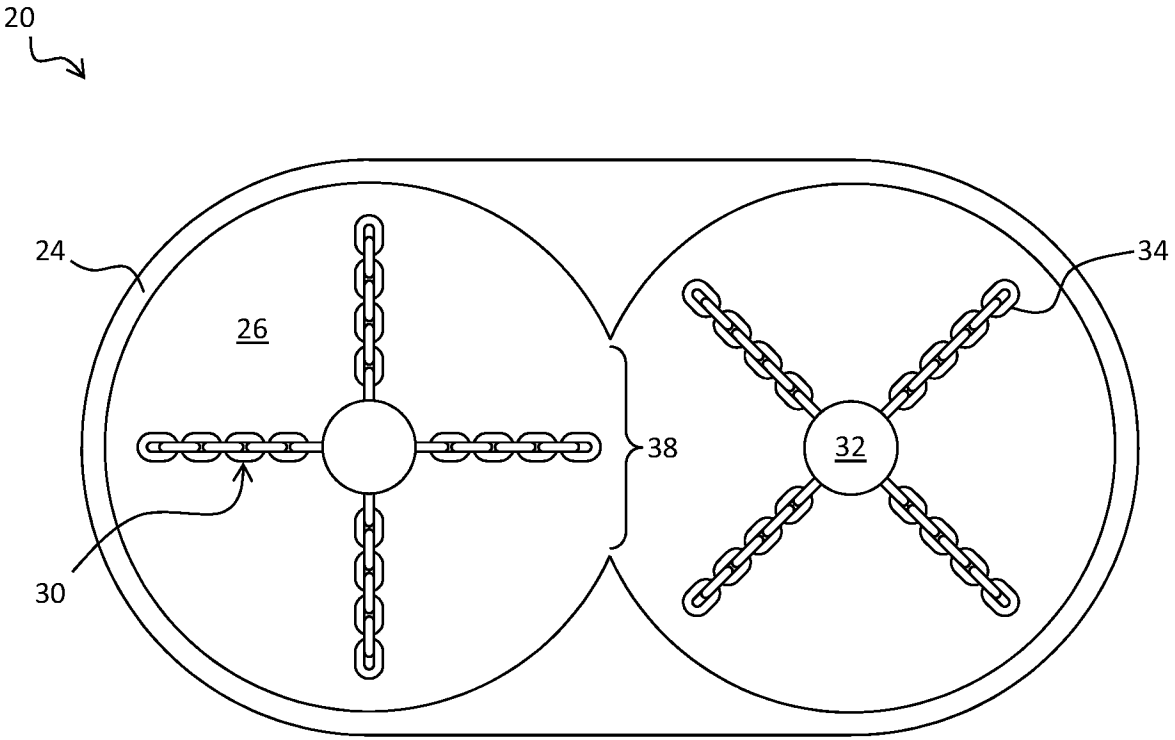
FIG. 1 shows a plan view of a mill according to the invention.
Figure 2:
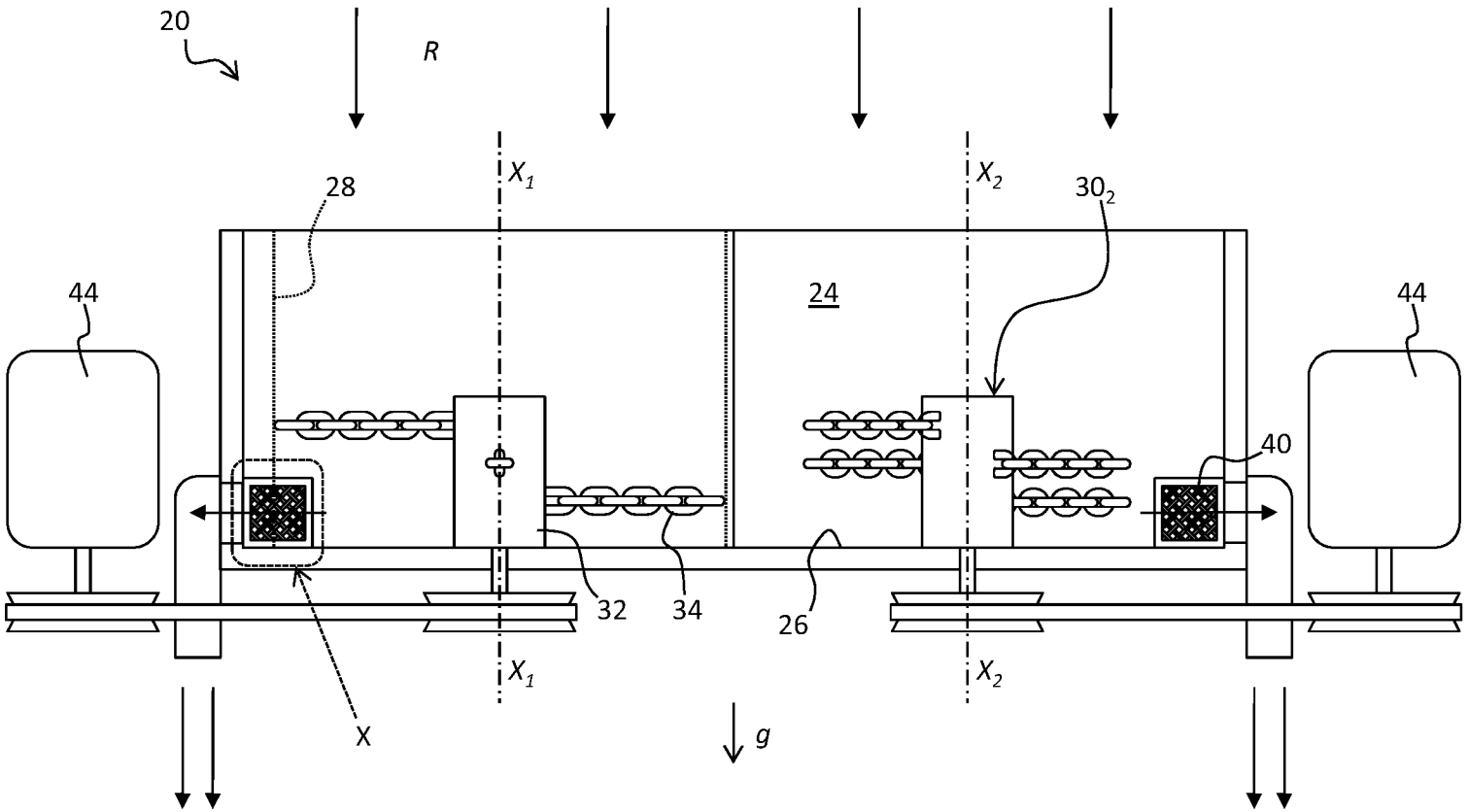
FIG. 2 shows a side view of a mill similar to that of FIG. 1 where, for greater clarity, part of the side wall has been removed.
Figure 3:
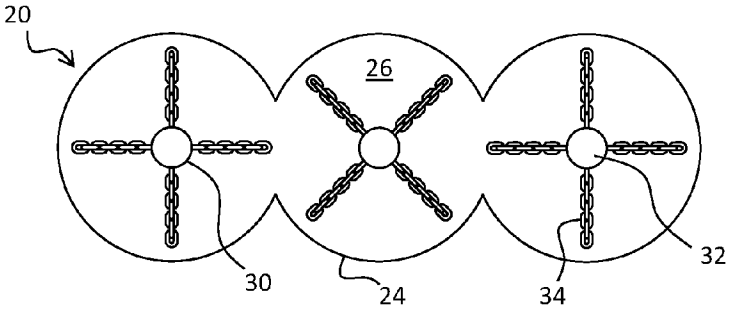
FIG. 3 shows schematically a plan view of another embodiment of the mill according to the invention.
Figure 11:
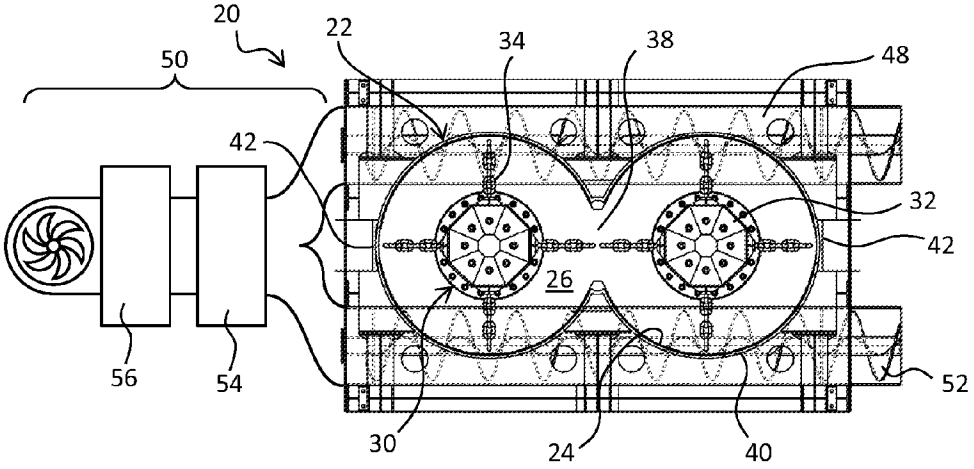
Figure 12:
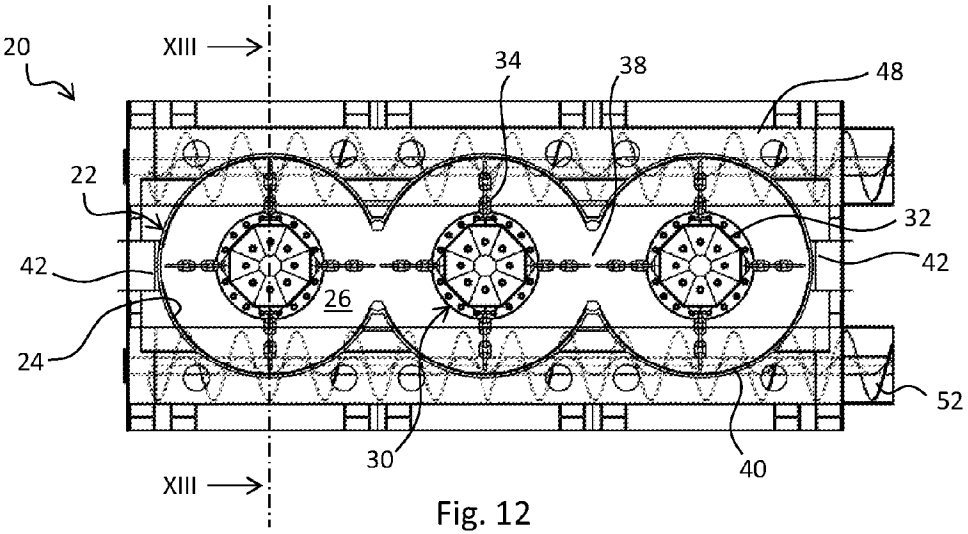
Figure 13:
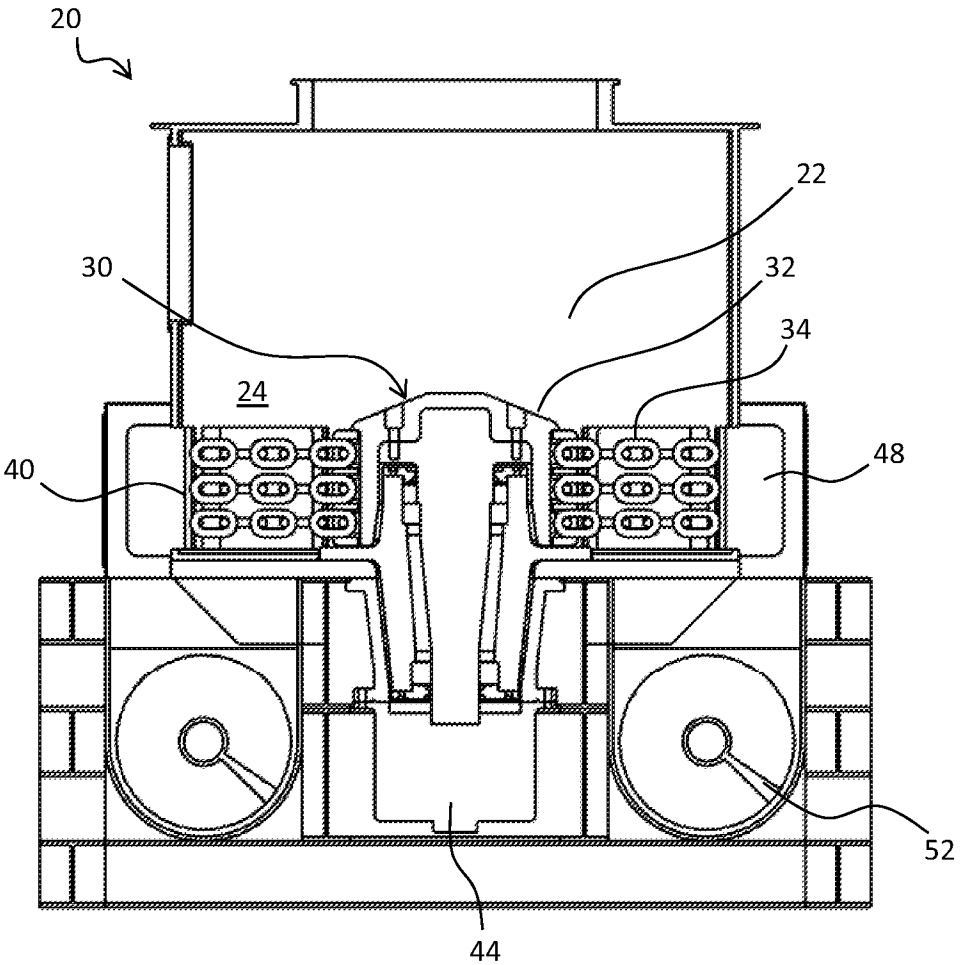
Figure 14:
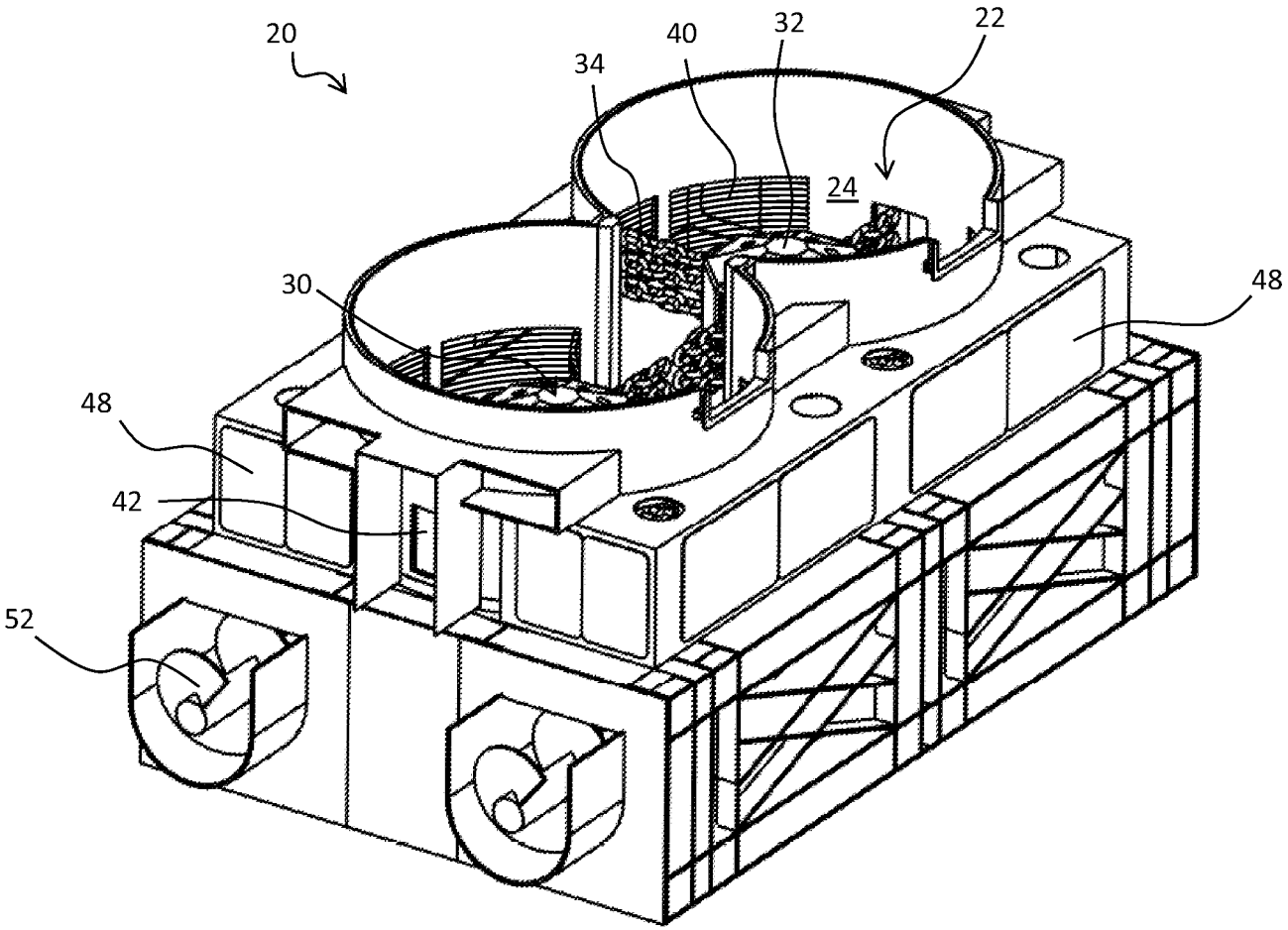

FIGS. 10.*a* to 10.*f* show schematically a number of embodiments of the detail indicated by X in FIG. 2;

FIG. 11 shows a plan view of a mill similar to that of FIG. 1 with some parts shown semi-transparent;

FIG. 12 shows a plan view of a mill similar to that of FIG. 3 with some parts shown semi-transparent;

FIG. 13 shows a cross-sectional view along the line XIII-XIII of FIG. 12; and FIG. 14 shows an axonometric view of a mill similar to that of FIG. 11 where, for greater clarity, some accessory parts have been removed.

Detailed Description of Embodiments of the Invention

With reference to the accompanying figures, a mill for grinding waste or rubbish R is denoted in its entirety by 20.

The mill 20 comprises at least one grinding chamber 22 defined by a side wall 24 and a floor 26. The mill 20 also comprises at least two rotors $\mathbf{30}_1$ and $\mathbf{30}_2$ rotatable about respective substantially vertical axes $X_1$ and $X_2$. Each of the rotors 30 comprises a hub 32 and a plurality of chains 34 connected to the hub 32 and designed to sweep over part of the grinding chamber 22 during rotation of the rotor 30.

As already mentioned above, each of the rotors 30 of the mill 20 according to the invention defines a specific axis of rotation X. In the present description, some conventions have been adopted as follows. "Axial" is understood as meaning the direction of any straight line parallel to the axis X. "Radial" is understood as meaning the direction of any straight half-line which has its origin on the axis X and is perpendicular thereto. "Circumferential" (or "tangential") is understood as meaning the direction of any (straight line tangential to a) circumference centred on the axis X and arranged in a plane perpendicular thereto.

The mill 20 is also subject to the acceleration of gravity indicated in FIG. 2 by the vector g. The description below refers, except where specifically indicated otherwise, to the mill 20 in the working configuration, i.e. the common concepts of vertical, horizontal, high, low, etc. are specifically defined with reference to the acceleration of gravity g.

As can be noted in the accompanying figures (in particular FIGS. 2 and 7), the grinding chamber 22 has internally a number of grinding volumes 28 corresponding to the number of rotors 30 present in the mill 20. The grinding volume 28 of a specific rotor 30 is defined here as being the volume, included inside the grinding chamber 22, defined by axially interpolating the circumferences inside which the chains 34 of that specific rotor 30 rotate. This volume is by its nature characterized by a rotational symmetry about the respective axis X. According to the embodiments shown in the accompanying figures, all the chains 34 of a single rotor 30 have an identical length and therefore the grinding volumes 28 assume the form of straight circular cylinders.

According to other embodiments (not shown) said volumes assume other forms which arc considered to be suitable for managing the flow of waste R inside the mill 20. According to some embodiments of the mill 20, the grinding volumes 28 of the rotors 30 are separate from each other.

According to the embodiments shown in the accompanying FIGS. 1, 3, 4 and 6 to 9, the grinding chamber 22 is obtained from the net sum of the grinding volumes 28 of the single rotors 30. In other words there is no portion of the plan area of the grinding chamber 22 which is not included within one of the grinding volumes 28 and which therefore is not affected by rotation of at least one chain 34

According to these embodiments, the side wall 24 is therefore shaped so as to follow precisely the profile of the grinding volumes 28 and therefore that of the grinding chamber 22. It can be seen how in the accompanying figures, for greater clarity, a relatively large distance is shown between the radial ends of the chains 34 and the side wall 24. In reality this distance is decidedly smaller. Similarly, in the accompanying FIGS. 2 and 7, for greater clarity, a relatively large distance is shown between the grinding volume 28 and the side wall 24 which follows its profile. In reality this distance is decidedly smaller.

Figure 4:
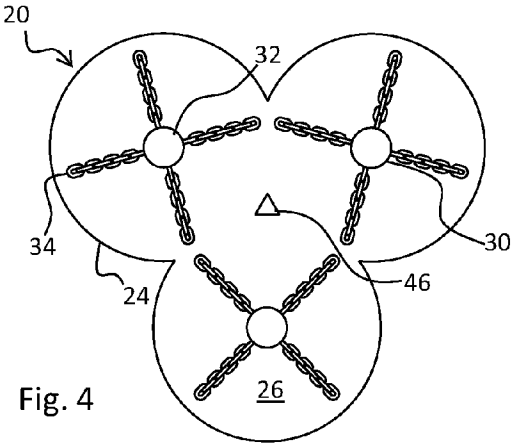
FIG. 4 shows schematically a plan view of another embodiment of the mill according to the invention.
Figure 5:
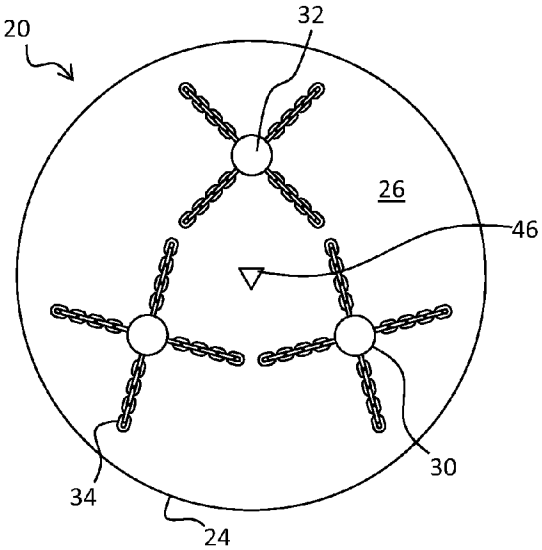
FIG. 5 shows schematically a plan view of another embodiment of the mill according to the invention.

According to the embodiment shown in FIG. 5, instead, the grinding chamber 22 is obtained from the sum of the grinding volumes 28 of the three rotors 30 plus a number of connecting volumes. In other words there are some portions of the plan area of the grinding chamber 22 which are not included within any of the grinding volumes 28 and which therefore are not affected by rotation of a chain 34. As can be noted, in fact, the grinding volumes 28 of the mill in FIG. 20 are entirely identical to those of the mill 20 shown in FIG. 4, while the respective grinding chambers 22 are different. While the grinding chamber 22 of the mill 20 in FIG. 4 has a plan area consisting of three lobes following the grinding volumes 28, the grinding chamber 22 of the mill 20 according to FIG. 5 has a circular plan area, bigger than the one above.

Figure 6:
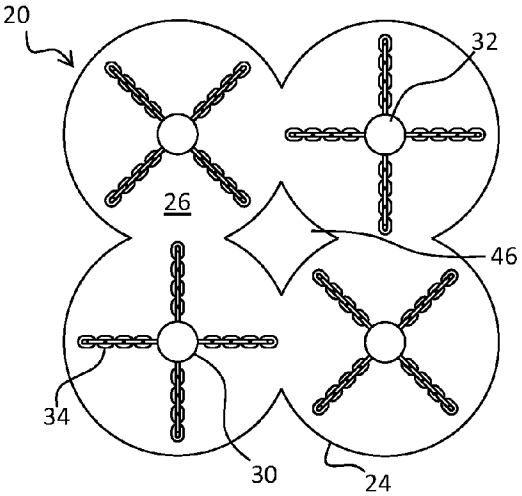
FIG. 6 shows schematically a plan view of another embodiment of the mill according to the invention.

As can be noted, in the accompanying FIGS. 4 to 6 the grinding chamber 22 has internally a number of obstacles 46. These obstacles 46 fill the spaces of the grinding chambers 22 which do not belong to any of the grinding volumes. They may be considered as forming an ideal continuation of the side wall 24. The presence of the obstacles 46 has a dual function. Firstly the obstacles prevent the accumulation of masses of waste at points in the grinding chamber 22 which are not reached by any chain 34. The accumulation and consequent presence of waste R which is not subject to the action of the chains 34 would result in an overall reduction in the efficiency of the process. Moreover, the obstacles 46 offer further surfaces and edges suitable for generating the impacts necessary for breaking up the waste R.

According to certain embodiments, the axes of rotation X of the rotors 30 are fixed, both with respect to each other and with respect to the walls 24 of the grinding chamber 22. In other words, the interaxial distance between two rotors $\mathbf{30}_1$ and $\mathbf{30}_2$ of a same mill 20 is fixed; therefore the axes $X_1$ and $X_2$ of the two rotors $\mathbf{30}_1$ and $\mathbf{30}_2$ cannot be either moved towards each other or away from each other.

According to the embodiments shown in the accompanying figures, the side wall 24 is substantially vertical and has a cylindrical shape, at least along sections, while the floor 26 is substantially horizontal. According to other possible embodiments, the side wall 24 could for example be inclined so as to have a conical configuration along sections. This solution could for example be useful for taking into account the specific forms chosen during the design stage for the grinding volumes 28 of the rotors 30. Moreover, the floor 26 could be not flat, could be not horizontal or could be neither flat nor horizontal. The floor could for example have an inclined configuration, even only along sections. This solution could be useful in particular conditions for facilitating the expulsion of certain fractions of the waste R being processed inside the mill 20.

As can be understood from the accompanying figures, inside each mill 20, the grinding volumes 28 of the various rotors 30 are adjacent to each other in pairs, defining a tangency zone 38 via which the two volumes 28 communicate with each other. In other words, in the tangency zones 38 there is no fixed obstacle which opposes the passage of material from the grinding volume $\mathbf{28}_1$ of one rotor $\mathbf{30}_1$ to the grinding volume $\mathbf{28}_2$ of the adjacent rotor $\mathbf{30}_2$.

Figure 8:
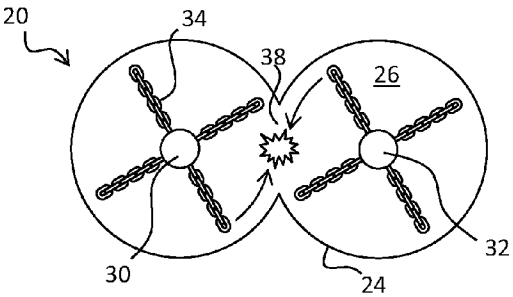
FIG. 8 shows a plan view of a mill similar to that of FIG. 1, wherein a first mode of operation of the invention is schematically illustrated.
Figure 9:
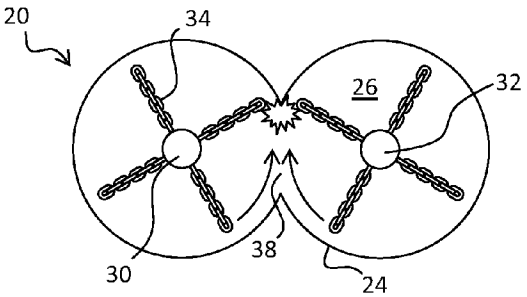
FIG. 9 shows a plan view of a mill similar to that of FIG. 1, wherein a second mode of operation of the invention is schematically illustrated.

In the light of the above comments and with particular reference to FIGS. 8 and 9, the operating principle of the mill 20 according to the invention is now described in detail. The waste R introduced from above into the mill 20 falls by means of gravity and in a more or less random manner comes into contact with the chains 34 of the rotors 30. As already described in relation to the prior art, MSW characteristically behaves in general in such a way as to cause the generation of substantially inelastic collisions. As a result, following a few impacts due to the passage of the waste through the rotational levels of the various chains 34, the waste itself ends up resting on the floor 26 and being rotationally driven by the lowest chain 34. However, unlike that which occurs in mills of the known type, the waste which starts to rotate inside the mill 20 according to the invention undergoes a further series of impacts which quickly reduce it to the desired particle size. The rotational movement of the chains 34 imparts a high circumferential velocity to the waste R and consequently subjects it to a high centrifugal acceleration. This means that any waste which starts to rotate together with a chain 34 adheres to the side wall 24 and is conveyed along it in the circumferential direction as far as the tangency zone 38 where the side wall 24 follows a path different from that of the grinding volume 28.

At this point, two different phenomena may occur depending on whether the rotation of the two adjacent rotors 30 is in the same direction or in different directions.

With specific reference to FIG. 8 the effect which occurs in the tangency zone 38 between two adjacent rotors 30 which rotate in the same direction is now described. In this situation, the waste rotated by the right-hand rotor and the waste rotated by the left-hand rotor come into contact with each other. In fact, the centrifugal acceleration which acts on both of them tends to cause them to move towards each other. The impact between said waste occurs at a very high relative speed defined by the sum of the tangential velocities of the waste propelled from the right-hand side and left-hand side. These velocities are similar in terms of modulus, but have an opposite direction. The effect of these impacts is such as to cause rapid grinding of the waste R. The efficiency of this action may be aided by the sporadic presence, inside the mass of waste R to be treated, of bodies which cannot be ground. These bodies in fact maintain a high capacity for impact against other waste, causing breaking up thereof.

With specific reference to FIG. 9 the effect which occurs in the tangency zone 38 between two adjacent rotors 30 which rotate in the opposite direction is now described. In this situation, the waste rotated by the right-hand rotor and the waste rotated by the left-hand rotor come into contact with each other. In fact, the centrifugal acceleration which acts on both of them tends to cause them to move towards each other. The impact occurs between the waste and the corner edge defined by the side wall 24. The tangential velocities of the waste propelled from right-hand side and left-hand side in fact have the same modulus and same direction. In this case also the effect of these impacts is such as to cause rapid grinding of the waste. In this case also the efficiency of this action may he aided by the sporadic presence, inside the mass of waste R to be treated, of bodies which cannot be ground. These bodies in fact maintain a high capacity for impact against other waste, causing breaking up thereof against the corner edge.

According to one embodiment the tangential velocity of the ends of the chains 34 is equal to about 270 km/h±30%, the tangential velocity therefore ranging between about 190 km/h and about 350 km/h.

In view of the above values, the impact which occurs between the waste inside a mill such as that schematically shown in FIG. 8 occurs at a relative speed of about 540 km/h±30%, defined by the sum of the tangential velocities of the waste propelled from the right-hand side and left-hand side; the velocity of the impacts therefore ranges between about 380 km/h and about 700 km/h.

Figure 7:
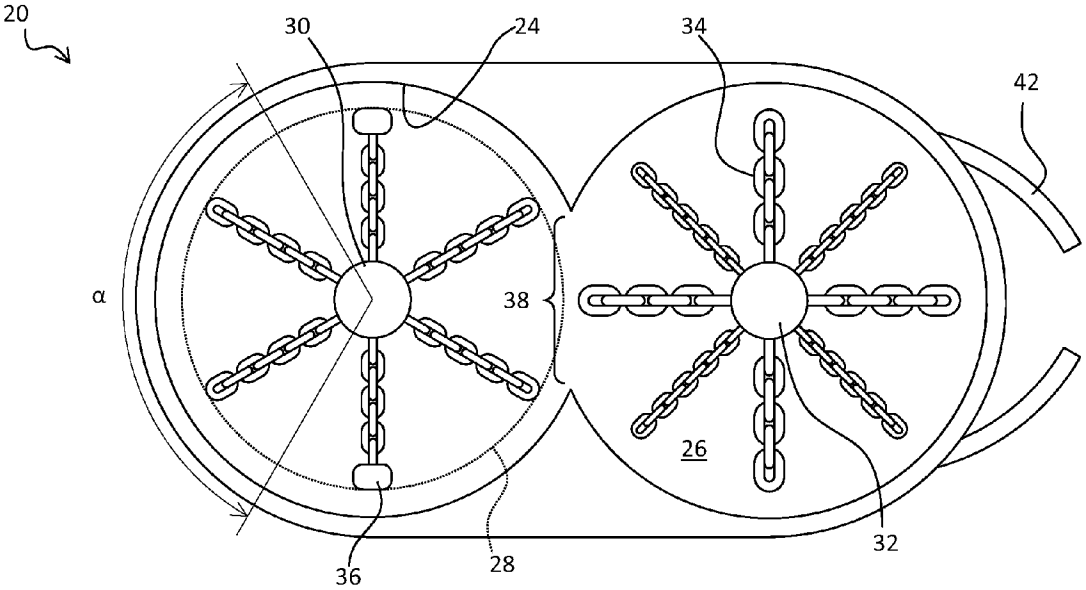
FIG. 7 shows a plan view of a mill similar to that shown in FIG. 1.

According to some embodiments of the invention, the chains 34 may be present in different numbers and may have different forms, sizes and weights. FIGS. 1 to 6 show only rotors with four chains 34 in which a single type of chain is used. FIG. 7 instead show in schematic form a number of possible variants of the chains 34. The left-hand rotor uses six chains, while the right-hand chain uses eight chains. It is obviously possible for different numbers of chains to be used. As the person skilled in the art may easily understand, a consideration which arises at the moment of choosing the number of chains 34 for each rotor 30 is that of balancing the rotor during rotation in order to prevent as far as possible the generation of vibrations which may be bothersome or even give rise to structural resonance.

The left-hand rotor in FIG. 7 also comprises two chains provided with end hammers 36. This solution may be particularly useful if the weight of the chain 34 is to be increased without increasing excessively the size of the links. In this way the inertial characteristics with regard to the capacity for impact on the mass of waste R and extension during rotation may be increased, without dispensing with the intermediate flexibility.

Compared to the four chains 34 without end hammers 36 of the left-hand rotor, the right-hand rotor comprises four chains which are lighter and four chains which are heavier.

According to other embodiments (not shown) in place of actual chains with annular links, such as those which can be seen in the shown embodiments, other flexible components which have a similar behaviour may be used. In order to satisfy specific requirements it is possible to use for example, instead of proper chains, sections of rope, cable, cord or the like. It can thus be understood that the term "chains" is used in the present description in its widest sense.

Another important design parameter for the chains 34 is the axial position along the hub 32. FIG. 2 shows schematically a number of possible axial arrangements. The left-hand rotor clearly shows three chains 34 at three different heights, while the fourth chain, owing to the particular position of the hub 32, is not visible. The right-hand rotor shows instead all four chains, from where it can be seen (owing to the particular choice performed in this case) a single chain occupies the highest position, a single chain occupies the lowest position, while two chains, which are diametrically opposite each other, share the intermediate position.

The number of chains 34 for each rotor 30, as well their form, their dimensions, their weight and their axial arrangement, may be chosen depending on the type of waste R which in any case must be processed inside the mill 20.

The chains 34 are in fact connected to the respective rotor 30 in a rigid, but removable manner. This solution, in addition to the possibility of varying the design parameters of the chains 34 used during grinding, also allows the worn or damaged chains 34 to be easily replaced.

According to some embodiments of the invention, the grinding chamber 22 also comprises grilles 40 suitable for allowing expulsion of the ground waste during operation of the mill 20. In other words, the fraction of waste which has already been ground and which has reached a sufficiently small particle size may be expelled from the grilles 40 during operation of the mill 20. The grilles 40 occupy preferably the bottom part of the side wall 24 (as in the embodiment of FIG. 2) or part of the floor 26 (not shown in the figures).

The expulsion of the ground waste is favoured by the action of the rotor 30 and in particular the chains 34 which constantly move the mass of waste R being processed and in particular impart a centrifugal acceleration. In accordance with this sequence of movements, therefore, the mass of waste which has not yet been ground or cannot be ground presses against the mass of waste already ground so as to push it out of the grinding chamber 22 through the grilles 40. Other possible embodiments of the grille 40 are shown in the accompanying FIG. 10.

FIG. 7 shows schematically the angle $\alpha$ over which the grilles 40 extend. In accordance with the invention, the angle $\alpha$ may be advantageously between 90° and 270°. A wider angle $\alpha$ allows easier and faster removal of the already ground waste, therefore reducing its dwell time inside the grinding chamber 22.

According to certain embodiments of the mill 20, for example those shown in FIGS. 11 to 14, the grilles 40 divide the grinding chamber 22 from one or more suction chambers 48 which are kept under a vacuum by means of a suction plant 50. The floor of the suction chambers 48 communicates with a feeder screw 52 designed to remove the already ground waste.

The operating principle of these embodiments of the mill 20 is explained hereinbelow. The action of the suction plant 50 generates an air flow which from the outside enters into the mill 20 from above, passes through the grilles 40 and goes along the suction chambers 48. This air flow therefore follows the same path envisaged for the waste R. The air flow prevents the more volatile fractions of the already ground waste from remaining unnecessarily inside the grinding chamber 22 or from being able to pass out from the top of the mill. These volatile fractions, in fact, being much more subject to aerodynamic forces rather than inertial forces, are not particularly affected by the high centrifugal forces which arc produced by the rotor 30. For this reason, by means of the action of the suction system 50, these fractions may be effectively removed from the grinding chamber 22. The already ground waste R, whether it consists of heavy waste (extruded by the centrifugal action of the rotor 30) or light waste (sucked by the action of the suction plant 50) therefore passes through the grilles 40. Once expelled into the suction chambers 48 through the grilles 40, the heavier fractions of the waste R fall into the underlying feeder screw 52 which conveys them to the following stations in the plant. The lighter fractions may instead be conveyed by the air flow along the suction chamber 48 and then along the suction plant 50. As schematically shown in FIG. 11, the suction plant 50 comprises a calming chamber 54 inside which there is a substantial increase in the cross-section of the duct along which suction takes place. The increase in the cross-section of the duct, the flowrate of the air sucked by the plant being the same, results in a drastic reduction in the speed of the air flow. This slowing down of the low reduces the aerodynamic forces which act on the suspended particles, which particles may then separate from the flow and fall. For the even lighter and more volatile particles which are in any case conveyed by the air flow despite being slowed down, a bag filter 56 is provided downstream of the calming chamber 54. The bag filter 56 is kept operating efficiently in a known manner for example by means of periodic shaking movements which cause the accumulated particles to fall. The particles conveyed by the air flow and captured by the calming chamber 54 and by the bag filter 56 are then reconveyed to the main flow of the already ground waste R, for example to the feeder screws 52.

Previously reference was made to the presence of non-grindable bodies inside the mass of waste R being processed. This presence, although sporadic and even though theoretically not likely to occur owing to the specific legal provisions applicable in respect of waste disposal, must nevertheless be taken into consideration at the design stage and during use of a waste grinding apparatus such as the mill 20 according to the invention. In this connection it was mentioned above how the presence of non-grindable bodies may, to a certain extent, favour the breaking up action (owing to the impacts in the tangency zone 38 between the different grinding volumes 28) and expulsion of the ground waste (owing to the centrifugal force which acts on the non-grindable bodies and the thrust which the latter produce on the ground fraction). Nevertheless, the accumulation of an excessive amount of non-grindable bodies is to be avoided so as not to occupy the working volume nor increase excessively the working load acting on the rotors 30. According to some embodiments (see for example the embodiment shown in FIG. 7) the mill 20 according to the invention comprises at least one hatch 42 for allowing periodic removal of the non-grindable bodies.

FIG. 7 also shows one of the possible configurations for driving the mill 20. In the particular configuration, each of the two rotors 30 is rotated, via a belt drive, by an associated motor 44.

Obviously other driving configurations are possible. It is possible for example to drive more than one rotor 30 by means of a single motor 44. This solution could be particularly advantageous should it be required to obtain synchronized rotation of the various rotors 30. Also a gearbox may be arranged between the motor 44 and the rotor 30 so as to be able to obtain different speeds of rotation of the rotor 30 depending on the specific processing requirements.

According to the embodiment shown in FIG. 13, the motor 44 is instead contained inside the associated hub 12, in a configuration which is commonly known as a direct drive. This configuration offers various advantages compared to the configurations described above, said advantages being due in particular to the elimination of any form of mechanical drive. Above all the system is simpler and therefore ensures a greater degree of reliability and greater efficiency. The mechanical simplicity also reduces the manufacturing and management costs.

Finally, the greater compactness of the direct drive solution results in easier and more rational deployment of the other auxiliary components of the mill 20 and/or of the plant as a whole.

Obviously, in the absence of intermediate mechanical drives, the motor 44 must be able to impart directly the correct angular velocity to the rotor 30. The speed of rotation of the motor 44 must therefore be electronically controlled so that it can be kept within the desired values.

For example, in an embodiment of the mill 20 which has a diameter of the rotor equal to about 2.5 metres, in order ensure a tangential velocity of about 270 km/h at the ends of the chains 34, the speed of rotation of the motor 44 must be about 573 rpm during normal operation.

Obviously, according to other embodiments with different rotor diameters, the speed of rotation of the motor 44 during normal operation must be different so as to be able to keep the value of the tangential velocity of the ends of the chains 34 to within the desired values.

The motor 44 is preferably a "torque motor", i.e. a motor which is able to develop a high torque also at a low speed of rotation. These torque motors are usually synchronous permanent-magnet motors, preferably of the three-phase type. Advantageously, adjustment of the speed of rotation of the motor 44 may be achieved in a known manner by means of an inverter.

According to certain embodiments, removal of the non-grindable bodies is performed by means of automatic opening of the hatch 42. Automatic opening may be for example controlled by the power consumption of the motor 44: when the motor tends towards a consumption which exceeds a predefined threshold, it can be concluded that the chains 34 are dragging along the floor 26 a considerable quantity of non-grindable bodies. Upon reaching the power threshold, the hatch 42 is automatically opened for a few seconds, i.e. the time needed to allow expulsion of the non-grindable bodies by means of the centrifugal force. The power threshold value may be defined at the design stage by the mill manufacturer or, more advantageously, by the user of the mill. In this way it is in fact possible to take into account the specific characteristics of the different types of waste mass which may be processed.

According to other embodiments of the mill 20, automatic opening of the hatch 42 may be controlled by a system for detecting the temperature in the rotating mass of waste R. When an increase in the temperature is recorded, it can be deduced that a certain quantity of non-grindable bodies is rotating together with the waste and the friction which is produced as a result increases the temperature at least locally. When a threshold temperature is reached or when a threshold gradient in the temperature increase is recorded, the hatch 42 is automatically opened for a few seconds, i.e. the time needed to allow expulsion of the non-grindable bodies by means of the centrifugal force. The threshold temperature and/or its threshold gradient may be defined at the design stage by the mill manufacturer or, more advantageously, by the user of the mill. In this way it is in fact possible to take into account the specific characteristics of the different types of waste mass which may be processed.

According to other embodiments of the mill 20, automatic opening of the hatch 42 may be controlled by an algorithm which takes into consideration the power consumption of the motor 44. the temperature of the waste R and/or the temperature gradient.

The present invention also relates to a plant for recycling energy from the waste. The plant comprises a mill 20 in accordance with that described above and a burner suitable for optimum combustion of the RDF produced by the mill. The burner is of the type widely known in the sector for recycling energy from waste and in particular RDF.

In the light of the above description it will be clear to the person skilled in the art how the mill 20 and the plant according to the invention are able to overcome most of the drawbacks mentioned above with reference to the prior art.

In particular, it will be clear how the mill 20 according to the present invention is suitable for grinding different types of waste. It is in fact particularly suitable for grinding MSW, but is also suitable for WEEE and other types of solid waste.

It will also be clear how the mill 20 according to the present invention has an energy efficiency which is decidedly greater than that of the mills of the known type. It should be considered in this connection that a specific study carried out by the Applicant has quantified an energy expenditure typically of less than 80 kW for each tonne of waste converted from MSW into RDF with a fine particle size (less than 5 mm).

Moreover, it will be clear how the mill 20 according to the invention has a simple and strong structure which is able to withstand the presence of non-grindable material.

It will also be clear how with the plant according to the present invention it is possible to achieve easy and efficient recycling of energy from waste, in particular MSW.

Finally the present invention provides a mill which allows a reduction in the bacterial content present in the MSW treated inside it. In fact the presence of the MSW inside the grinding chamber and the amount of mechanical energy used by it cause a gradual increase in its temperature, in a similar manner to that already described in connection with the mills of the known type. In the mill according to the invention, however, easy expulsion of the non-grindable bodies and the continuous mixing achieved by the chains drastically limit the temperature peaks and at the same time distribute the heat within the entire mass of MSW being processed. The temperature generally settles in the range of about 60-80° C., without therefore any problem as regards softening of the thermoplastic fractions and the consequent blockage of the grilles. On the contrary, the effect which such heating has on the MSW is that of a treatment similar to pasteurization, i.e. a treatment where the bacterial, content is drastically reduced (by about 90%).

The embodiment comprising two rotors 30 (shown for example in FIGS. 1, 2, 7 to 9, and 11 to 14) is the basic embodiment of the mill 20. It ensures all the advantages mentioned above and therefore represents a substantial improvement compared to the mills of the known type. The embodiment comprising three rotors in line (shown for example in FIGS. 3 and 12) represents a further improvement. In the light of the explanation of the mechanism for breaking up the waste inside the mill 20, it will in fact be clear to the person skilled in the art how with the three-rotor mill, which has two tangency zones 38 instead of one, it is possible to treat a quantity of waste substantially twice that of the basic mill with two rotors. It will also be clear how this embodiment is particularly effective since, while there is an increase in the size and number of components compared to the two-rotor version, the disposal capacity which can be achieved with it is significantly greater.

Other embodiments with three rotors but with several tangency zones 38 (such as for example those illustrated in FIGS. 4 and 5) or also other embodiments with more than three rotors (such as that for example the one illustrated in FIG. 6) are instead less advantageous, mainly owing to the logistical problems encountered during transportation and installation and associated with their overall dimensions.

As has already been mentioned above, in the plants of the known type, in order to process the waste R so as to obtain the production of RDF, a series of several machines is envisaged: a primary crusher (which initially breaks up the waste R into larger size pieces), a secondary crusher provided with blades situated closer together so as to reduce the size of the pieces, and finally a blade crusher for obtaining the final particle size of about 25 mm.

This particle size is however relatively coarse and therefore, in order to achieve efficient combustion, the RDF must be used together with a greater percentage amount (65-80%) of coal dust.

In the mill according to the present invention, instead, the production of RDF is performed in a single pass. In other words, the mill according to the invention is able to process the waste mass as such, i.e. as supplied by the waste collection services, without any intermediate treatment. Independently of the size of the incoming waste R, the mill alone according to the invention is able to achieve proper pulverization thereof: most of the RDF being output has a powdery and/or filamentous consistency and size.

Specific tests carried out by the Applicant have shown that on average more than 80% of the material output from the mill has characteristic dimensions smaller than 1 mm. The remaining percentage has dimensions which are slightly bigger and only occasionally reach 5 mm. Obviously said data has a value of a simply statistical nature: slight variations in the results may be determined by the nature and the characteristics of the incoming waste R.

It is precisely owing to this pulverized and/or fibreless consistency and size that the RDF produced by the mill according to the invention is able to ensure optimum combustion to the point of being able to replace the coal dust by up to 100%.

This result, together with the limited energy expenditure required to achieve it, is such that the mill 20 according to the invention represents a decidedly advantageous solution compared to the plants of the known type.

With regard to the embodiments of the mill 20 described above, the person skilled in the art may, in order to satisfy specific requirements, make modifications to and/or replace elements described with equivalent elements, without thereby departing from the scope of the accompanying claims.

The invention claimed is:

1. Mill for grinding rubbish, comprising:

one or more grinding chambers each defined by a side wall and by a floor, each grinding chamber comprising at least two rotors rotatable about respective, substantially vertical axes, each of the rotors comprising a hub and a plurality of chains connected to the hub, the plurality of chains for each of the rotors, during rotation of the rotors, configured to sweep over part of the grinding chamber; and one or more suction chambers divided from each grinding chamber by means of grilles, the one or more suction chambers being kept under vacuum by means of a suction plant;

wherein a grinding volume is defined for each of the at least two rotors of each grinding chamber, the grinding volume of each of the rotors defined by axially interpolating a circumference inside which the plurality of chains of the rotor correspondingly rotate;

wherein each of the at least two rotors of each grinding chamber is spaced such that the grinding volumes of the rotors are separate so as not to overlap;

wherein the side wall of each grinding chamber is shaped so as to precisely follow profile of the grinding volumes of the at least two rotors of the grinding chamber; and wherein the vertical axes of the at least two rotors of each grinding chamber are fixed relative to each other and the side wall of the grinding chamber.

2. Mill according to claim 1, wherein each grinding chamber is obtained from a net sum of the grinding volumes of the at least two rotors of the grinding chamber, such that every portion of plan area of the grinding chamber is included within one of the grinding volumes of the rotors and is therefore affected by rotation of the plurality of chains of at least one of the rotors.

3. Mill according to claim 1, wherein each grinding chamber is obtained from a net sum of the grinding volumes of the at least two rotors of the grinding chamber and one or more connecting volumes, such that portions of plan area of the grinding chamber outside of the grinding volumes are unaffected by rotation of the plurality of chains of the rotors.

4. Mill according to claim 1, further comprising obstacles in each grinding chamber to fill spaces outside the grinding volumes of the at least two rotors.

5. Mill according to claim 1, wherein the grinding volumes of the at least two rotors of each grinding chamber are adjacently grouped in pairs, wherein for each of the pairs a tangency zone is defined via which the grinding volumes of the rotors communicate.

6. Mill according to claim 5, wherein each tangency zone is free of obstacles, permitting unimpeded passage between corresponding pairs of the grinding volumes.

7. Mill according to claim 1, wherein the plurality of chains of one or more of the at least two rotors comprise end hammers.

8. Mill according to claim 1, wherein each plurality of chains is connected to respective of the rotors in a rigid but removable manner.

9. Mill according to claim 1, wherein each grinding chamber comprises the grilles which are configured, during operation of the mill, to expulse already ground fractions of waste of fine particle size.

10. Mill according to claim 1, wherein tangential velocity of ends of the plurality of chains of the at least two rotors of each grinding chamber ranges between about 190 km/h and about 350 km/h.

11. Mill according to claim 1, further comprising a motor for each of the at least two rotors of each grinding chamber for rotationally driving the rotors, the motor for each rotor being contained inside the hub of the rotor.

12. Mill according to claim 1, further comprising at least one hatch defined for each grinding chamber, the hatch configured to allow periodic removal of non-grindable components from the grinding chamber.

13. Mill according to claim 12, further comprising at least one motor for rotationally driving said at least two rotors of each grinding chamber and for automatic opening of the at least one hatch.

14. Mill according to claim 12, wherein the at least one hatch for each grinding chamber is automatically controlled via sensor and is dependent on temperature of rotating mass of the rubbish.

* * * * *